US006378467B1

(12) United States Patent
Kobayashi et al.

(10) Patent No.: US 6,378,467 B1
(45) Date of Patent: Apr. 30, 2002

(54) PORTABLE POWER WORKING MACHINE

(75) Inventors: Fujio Kobayashi; Hiroji Kawasaki; Hisato Ohsawa, all of Tokyo; Katsuya Tajima, Saitama, all of (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/603,081

(22) Filed: Jun. 26, 2000

(51) Int. Cl.[7] ..... F01P 1/02
(52) U.S. Cl. ..... 123/41.56; 123/41.7
(58) Field of Search ..... 123/41.56, 41.7

(56) References Cited

U.S. PATENT DOCUMENTS 4,841,920 A 6/1989 Andreasson et al.
5,526,777 A 6/1996 Taomo et al.

FOREIGN PATENT DOCUMENTS

JP 05-195891 8/1993

*Primary Examiner*—Tony M. Argenbright
*Assistant Examiner*—Katrina B. Harris
(74) *Attorney, Agent, or Firm*—Baker Botts L.L.P.

(57) ABSTRACT

A portable power working machine which is provided with an internal combustion engine (20) and is designed to minimize the clogging of an air cleaner (31) attached to the air intake system of internal combustion engine (20). For this purpose, part of air introduced into the main housing (12) by means of the cooling fan (25) is allowed to be sucked again by the cooling fan, thereby enabling it to be recirculated through the carburetor chamber (40) and a circulating air duct (50) disposed outside the carburetor chamber (40), and at the same time, part of air introduced into the carburetor chamber (40) is allowed to be introduced from the air cleaner (31) into the internal combustion engine (20).

8 Claims, 7 Drawing Sheets

PORTABLE POWER WORKING MACHINE

BACKGROUND OF THE INVENTION

The present invention relates to a portable power working machine such as a chain saw, a power cutter, a hedge trimmer, etc., which is provided with an internal combustion engine as a driving power source for driving the working components thereof, and in particular, to a portable power working machine which is designed to prevent as much as possible an air cleaner attached to an air intake system of an internal combustion engine from being clogged with dust.

A conventional portable power working machine, such as a chain saw, is generally constructed such that a small air-cooled internal combustion engine acting as a driving power source for driving the working components, such as a saw chain, is mounted in a main housing, that a cooling fan driven by the internal combustion engine is disposed on one side of the main housing, and that a carburetor chamber housing therein an air cleaner and a carburetor is disposed on an upper rear side of the internal combustion engine.

In the operation of the portable power working machine as described above, dust that includes Sawdust of relatively large size, powder of cut material and sand-like dust is inevitably generated. When dust of those kinds is allowed to enter together with air into the air intake system of the internal combustion engine, and to collect on the filter element of the air cleaner, the clogging of the filter results, thus giving rise to an irregularity of the engine as well as a deterioration of performance of the engine due to an insufficiency in the flow rate of intake air. Accordingly, it is required in the operation of the portable power working machine to frequently clean the air cleaner, etc., which is a task that is quite troublesome for the operator.

BRIEF SUMMARY OF THE INVENTION

The present invention has been made to solve the aforementioned problems. In particular, it is an object of the present invention to provide a portable power working machine which is capable of preventing as much as possible an air cleaner of the air intake system of a small air-cooled internal combustion engine acting as a driving power source for working components from being clogged with dust, thereby relieving an operator from the task of frequently cleaning the air cleaner.

With a view to attaining the aforementioned object, there is provided, in accordance with the present invention, a portable power working machine comprising a small air-cooled internal combustion engine received in a main housing, a cooling fan which is adapted to be driven by the internal combustion engine and disposed on one side of the main housing, and an air cleaner disposed in the air-intake system of the internal combustion engine; wherein the power working machine is featured in that part of air introduced into the main housing by means of the cooling fan is allowed to be sucked again by the cooling fan so as to be recirculated.

In a preferred embodiment, a carburetor chamber housing therein the air cleaner and a carburetor is placed in the air-intake system of the internal combustion engine, wherein part of air introduced into the main housing by means of the cooling fan is allowed to be sucked again by the cooling fan, thereby enabling it to be recirculated through the carburetor chamber and a circulating air duct disposed outside the carburetor chamber, and at the same time, part of air introduced into the carburetor chamber is allowed to be introduced from the air cleaner into the internal combustion engine.

In this case, preferably, the circulating air duct may be disposed in such a manner that the open end on the upstream side thereof is positioned lower than the air cleaner housed in the carburetor chamber, while the open end on the downstream side thereof may be positioned in the vicinity of the air-intake port of the cooling fan.

In a more preferred embodiment, the circulating air duct may be constructed such that the upstream region of the passageway has a larger cross-sectional area than that of the downstream region of the passageway, and that a flange-like guiding member is placed in the vicinity of the aforementioned downstream side open end of the circulating air duct, thereby effectively enhancing the air intake power of the cooling fan.

A typical example of a portable power working machine in which the present invention is especially advantageous is a chain saw, which includes a saw chain set composed of a saw chain and a guide bar that is located on the side of the main housing opposite from the cooling fan and the carburetor chamber housing. Because chain saws produce large quantities of dust, including relatively large particles, reducing the rate of accumulation of dust on the air cleaner offers important improvements in the chain saw.

According to the aforementioned preferred embodiment of the portable power working machine, when the power working machine is operated, the air (cooling air) that has been introduced from one side of the main housing by the suction of the cooling fan and hence accelerated and pressurized is transmitted so as to cool the internal combustion engine and then discharged through a discharge port formed in the main housing toward the external atmosphere, part of air thus introduced into the main housing being sucked again by the cooling fan after passing through the carburetor and the circulating air duct so as to be recirculated, whereas part of the air introduced into the carburetor chamber is sucked into the internal combustion engine through the air cleaner and carburetor during the intake stroke of the engine.

In this case, since the circulating air duct is disposed in such a manner that the open end on the upstream side thereof is positioned lower than the air cleaner housed in the carburetor chamber, and the open end on the downstream side thereof is positioned in the vicinity of the air-intake port of the cooling fan, most of the dust existing in the air that has been introduced into the carburetor chamber is caused, due to the gravity thereof, to be sucked by the Cooling fan after passing through the carburetor chamber and the circulating air duct, thus preventing most of the dust from reaching the air cleaner.

As a result, it is now possible to minimize the clogging of the air cleaner, thus making frequent cleaning of the air cleaner unnecessary and improving the efficiency of work.

In another preferred embodiment of the portable power working machine according to the present invention, the air cleaner and carburetor are placed in the air-intake system of the internal combustion engine, wherein part of external air that has been pressurized and accelerated due to the sucking power of the cooling fan is caused to be sucked again by the cooling fan after passing through a discharge port formed at the outer periphery of a volute case and through the circulating air duct, thereby enabling part of external air to be recirculated, and at the same time, part of air flowing through the circulating air duct is caused to be separated from an intermediate portion of the circulating air duct and allowed to flow in a direction which is approximately orthogonal to the direction of the intermediate portion of the circulating air duct, thereby enabling the air to be introduced into the internal combustion engine through the air cleaner and the carburetor.

In this case, preferably, the circulating air duct is constituted by an upstream side passageway extending from the discharge port toward the air cleaner, the aforementioned intermediate passageway being disposed below the filter element of the air cleaner and communicating with the upstream side passageway, and a downstream side passageway communicating with the intermediate passageway and having an open distal end which is positioned in the vicinity of the intake port of the cooling fan.

In another preferred embodiment, a carburetor chamber housing a carburetor is placed in the air-intake system of the internal combustion engine, and the aforementioned air cleaner having a sheet-like filter element as a partitioning wall is disposed in the carburetor chamber.

According to the aforementioned preferred embodiment of the portable power working machine, when the power working machine is operated, the air (cooling air) that has been-introduced from one side of the main housing by the suction of the cooling fan and hence accelerated and pressurized is transmitted so as to cool the internal combustion engine and then, discharged through a discharge port formed in the main housing toward the external atmosphere. Part of air thus introduced into the main housing is sucked again by the cooling fan after passing through a discharge port formed at the outer periphery of a volute case and through the circulating air duct, thereby enabling part of the air to be recirculated. At the same time, part of air flowing through the circulating air duct is caused to be separated from an intermediate portion of the circulating air duct and allowed to flow in a direction which is approximately orthogonal to the direction of the intermediate portion of the circulating air duct, thereby enabling the air to be introduced into the internal combustion engine through the air cleaner and the carburetor.

In this case, since most of the dust present in the air being introduced from the discharge port into the circulating air duct is caused, due to the gravity and inertia thereof, to be sucked by the cooling fan after passing through the circulating air duct. The air which is separated from an intermediate portion (an intermediate passageway) disposed lower than the air cleaner in the circulating air duct and directed to flow in a direction orthogonal to the intermediate passageway can be substantially prevented from being contaminated by the dust.

As a result, it is now possible to minimize the clogging of the air cleaner, thus making frequent cleaning of the air cleaner unnecessary and improving the efficiency of work.

Further, although the quantity of air introduced into the internal combustion engine may be sharply reduced at the moment when the throttle valve of the carburetor is turned from a relatively wide-opened state back to a minimum opening (opening at idling of the engine), since the cooling fan can keep rotating at a high speed for a while due to the inertia, the sucking action by the cooling fan to the dust in the air cleaner chamber can be maintained, thereby making it possible to minimize the clogging of the air cleaner by this action of the cooling fan.

For a better understanding of the present invention and further advantages thereof, reference may be made to the following description of an exemplary embodiment, taken in conjunction with the accompanying drawings.

DETAILED DESCRIPTION OF THE INVENTION

Figure 1:
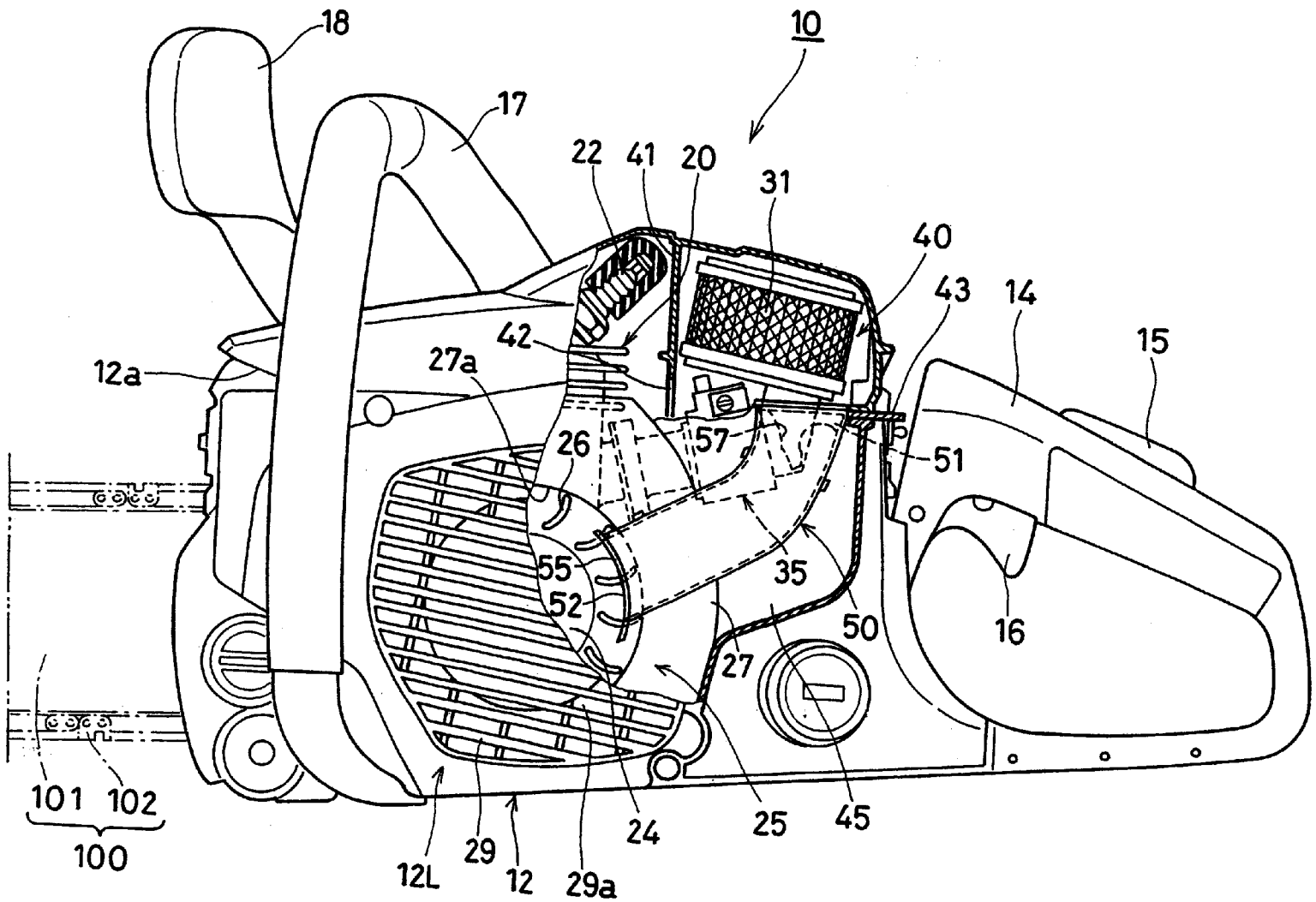
FIG. 1 is a partially sectioned longitudinal view showing the left side of a chain saw representing one embodiment of a portable power working machine according to the present invention.

Referring to FIG. 1, the illustrated embodiment is a chain saw 10, which includes, as a power driving source for actuating the working components, a small air-cooled two-stroke cycle gasoline engine (hereinafter referred to as an internal combustion engine) 20. The internal combustion engine 20 is mounted at approximately the central region of a main housing 12 made of a synthetic resin, the cylinder of the internal combustion engine 20 being vertically oriented. The internal combustion engine 20 is provided, on the top thereof, with an ignition plug 22 which is inclined rearwardly.

A saw chain set 100 composed of a guide bar 101 and a saw chain 102 slidably trained along the guide bar 101 is mounted as a working component on the forward right side 12R (FIG. 2) of the main housing 12. The saw chain 102 is driven, via a known transmission mechanism (not shown), by the internal combustion engine 20. Further, on the left side 12L (FIG. 2) of the main housing 12, there are disposed a cooling fan 25 that is driven by the internal combustion engine 20, and also a recoil starter case 29 provided with an air-intake slit 29*a* and covering the impeller 26 of the cooling fan 25 and a volute case 27. In FIG. 1, the reference number 14 denotes a rear handle, 15 a throttle lock lever, 16 a throttle trigger, 17 a front handle, and 18 a hand guard.

At an upper portion on the rear side of the internal combustion engine 20, there is provided a carburetor chamber 40 which is air-tightly defined by a fore-partitioning wall 41 provided with an inlet port 42, a lower partitioning wall 43, a side partitioning wall 45 (FIG. 2), etc., all disposed on the discharge side of the cooling fan 25 and inside the main housing 12. An air cleaner 31 and a diaphragm type carburetor 35 are also housed inside the carburetor chamber 40.

A circulating air duct 50 is located inside the main housing 12 between the volute case 27 of the cooling fan 25 and the recoil starter cover 29, as well as between the inlet side (the main housing 12 side) of the impeller 26 of the cooling fan 25 and the carburetor chamber 40.

Figure 3:
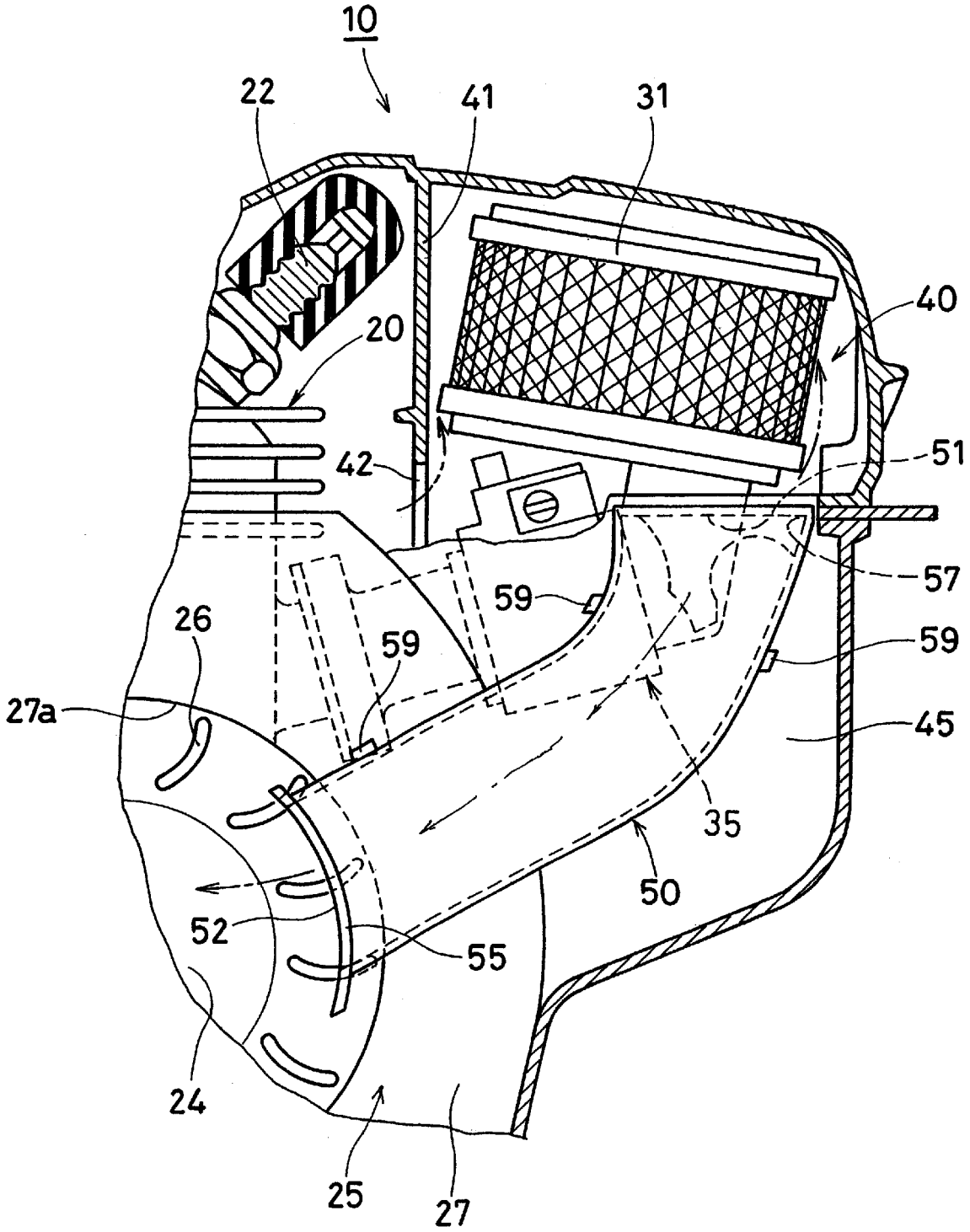
FIG. 3 is an enlarged partial sectional view illustrating a main portion of chain saw shown in FIG. 1.
Figure 4:
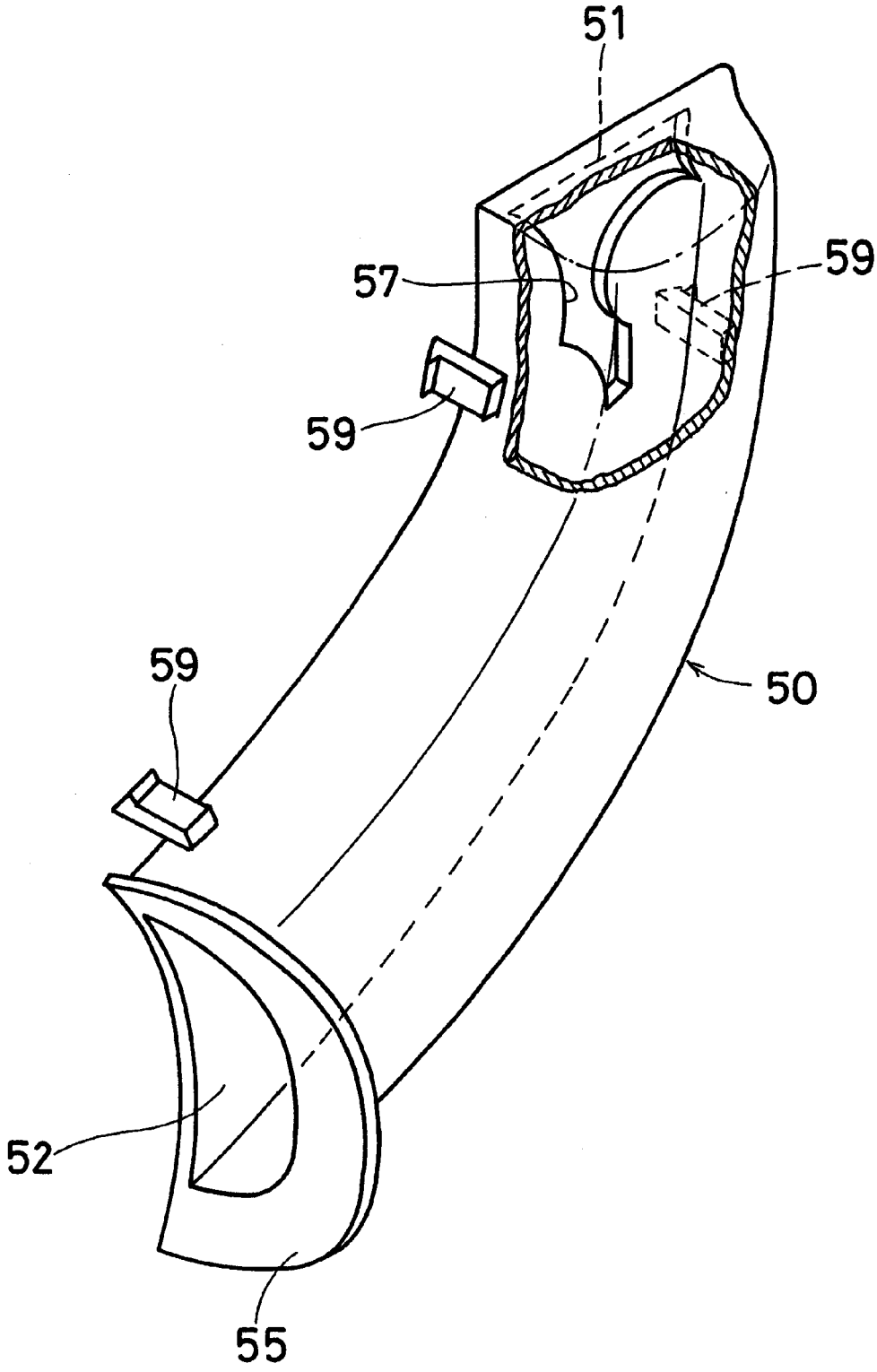
FIG. 4 is a partially cut perspective view illustrating the general structure of a circulating air duct to be mounted on the chain saw shown in FIG. 1.

As clearly shown in FIGS. 3 and 4, the circulating air duct 50 is formed of a flattened cylindrical body which is downwardly inclined and curved into an approximately L-shape as a whole, and designed such that part of air that has been introduced into the main housing 12 by means of the cooling fan 25 is allowed to be sucked again through the carburetor chamber 40 by the cooling fan 25 so as to be recirculated. The circulating air duct 50 is fixedly engaged with three claws 59 which are attached to the outer surface of the side wall 45 defining the carburetor chamber 40.

Figure 2:
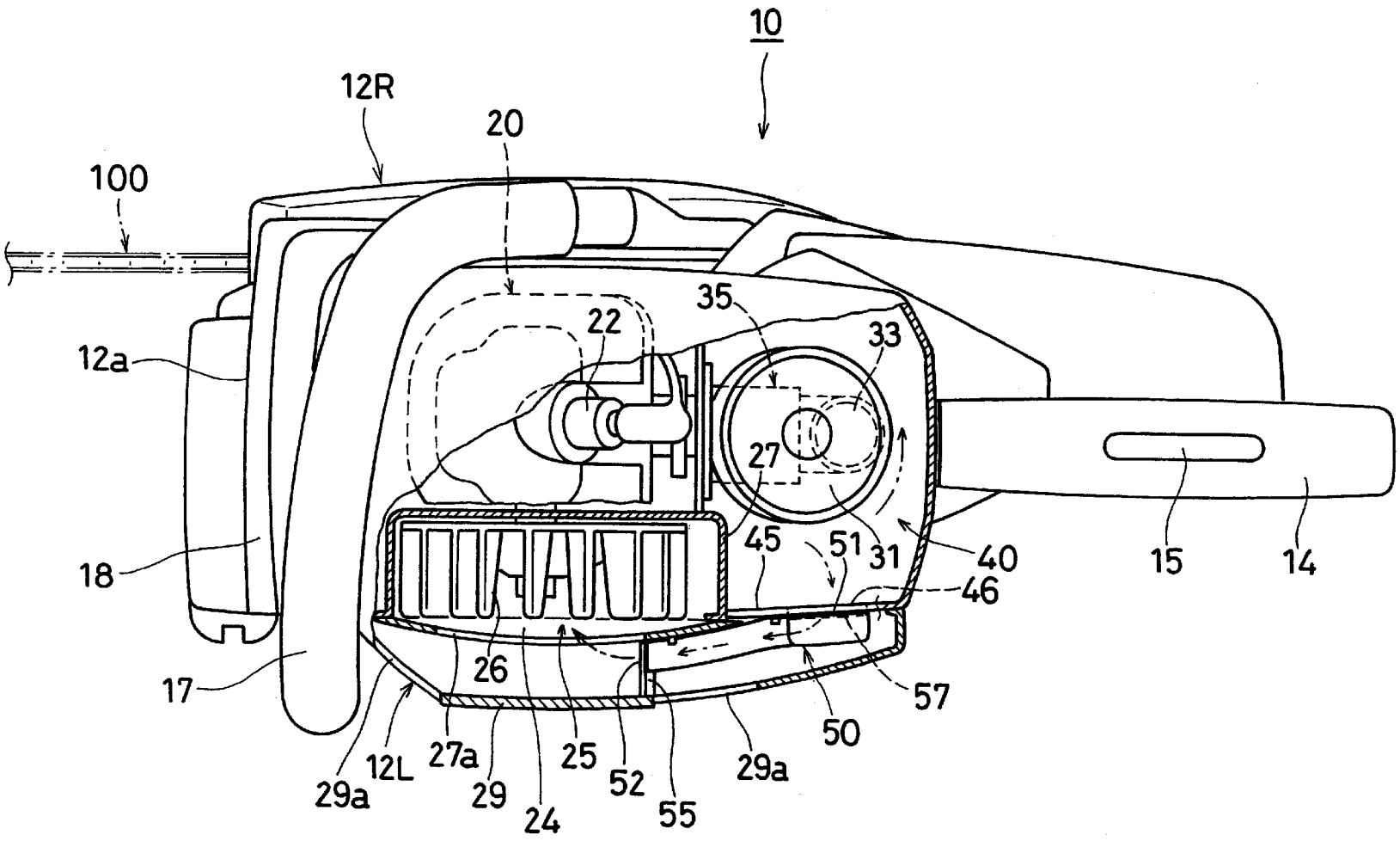
FIG. 2 is a partially cut plan view of the chain saw shown in FIG. 1.

The circulating air duct 50 is provided with a deformed triangular side opening 57 which faces an opening 46 formed in the side wall 45 (FIG. 2). The circulating air duct 50 is disposed in such a manner that the open end 51 on the upstream side thereof is positioned lower than the air cleaner 31 housed in the carburetor chamber 40, while the open end 52 on the downstream side thereof is positioned in the vicinity of the air-intake port 27*a* of the cooling fan 25 (closer to a central air inlet portion 24 than the center of the impeller 26).

Further, in order to prevent the dust in the air flow from counter-flowing, the circulating air duct 50 is constructed such that the upstream region (upper portion) of the passageway has a larger cross-sectional area (half moon shape) than that of the downstream region (lower portion) of the passageway. Additionally, with a view to effectively enhancing the air intake power of the cooling fan 25, a flange-like guiding member 55 of half moon shape is attached to the outer periphery of the downstream side open end 52 of the circulating air duct 50. The flange-like guiding member 55 also functions to partition the circulating air duct 50 from the interior of the recoil starter case 29.

According to the portable power working machine 10 of this embodiment as constructed above, during the operation thereof, the dust-containing air (cooling air) that has been introduced through the left side 12L of the main housing 12 by the sucking effect of the cooling fan 25, hence accelerated and pressurized, is transmitted so as to cool the internal combustion engine 20 and then is discharged outside through a discharge port 12*a* (FIGS. 1 and 2) formed at a portion of the main housing 12. At the same time, part of the air introduced into the main housing 12 is allowed to enter into the carburetor chamber 40 and, after passing through the carburetor chamber 40 and the circulating air duct 50, is sucked again by the cooling fan 25 so as to be recirculated (see the dot and dash line shown in FIGS. 2 and 3).

On the other hand, part of the air that has been introduced into the carburetor chamber 40 is allowed to be introduced into the internal combustion engine 20 through the air cleaner 31 and the carburetor 35 during the intake stroke of the internal combustion engine 20 (see the two dots and dash line shown in FIGS. 2 and 3).

In this case, since the circulating air duct 50 is disposed in such a manner that the open end 51 on the upstream side thereof is positioned lower than the air cleaner 31 housed in the carburetor chamber 40, and the open end 52 on the downstream side thereof is positioned in the vicinity of the air-intake port 27*a* of the cooling fan 25, most of the dust present in the air that has been introduced into the carburetor chamber 40 is caused, due to the gravity thereof, to be sucked by the cooling fan 25 after passing through the carburetor chamber 40 and the circulating air duct 50, thus preventing most of the dust from reaching the air cleaner 31. As a result, it is now possible to minimize the clogging of the air cleaner, thus making frequent cleaning of the air cleaner unnecessary and improving the efficiency of work.

Figure 5:
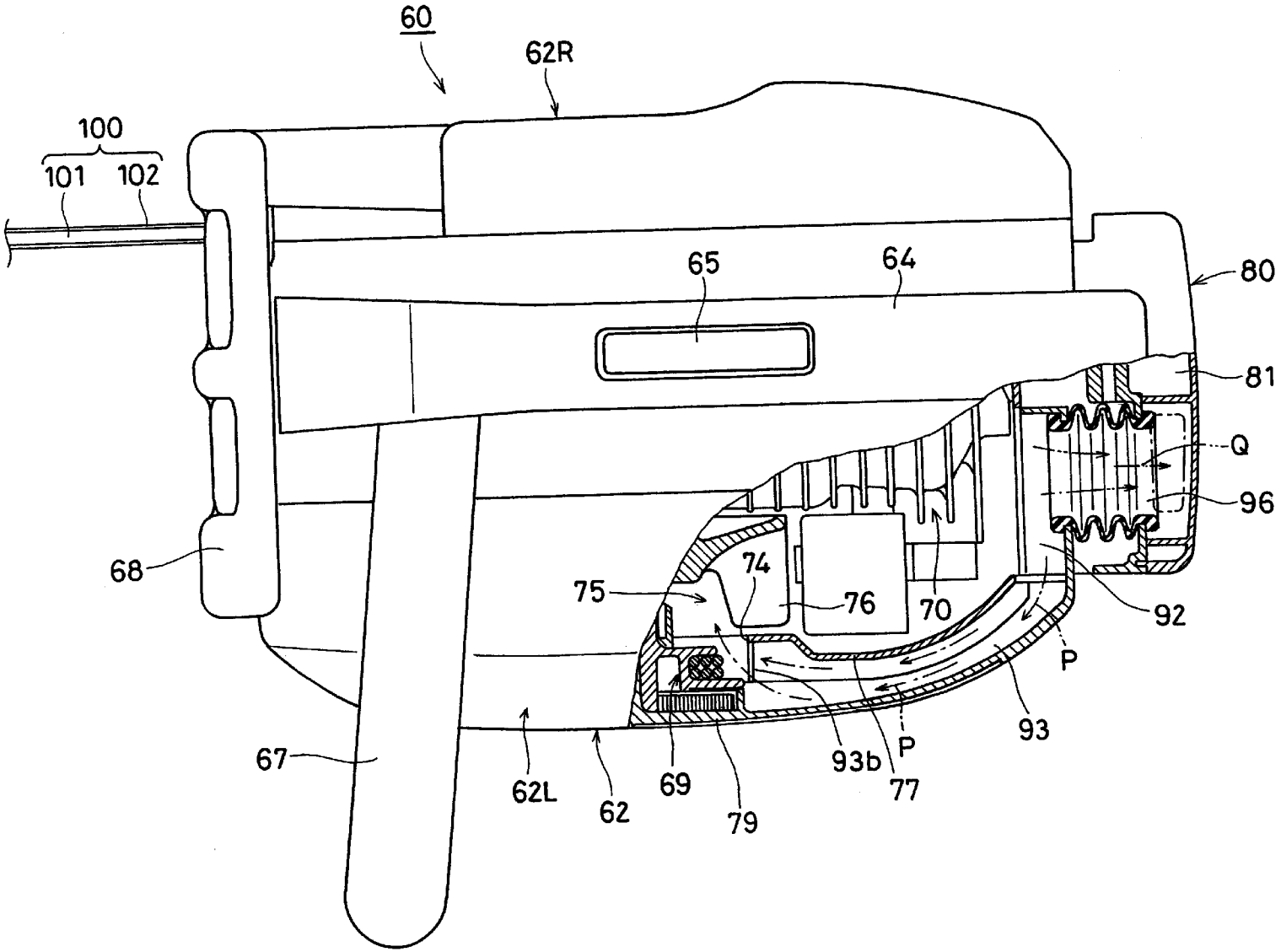
FIG. 5 is a partially cut plan view of the chain saw according to another embodiment representing a portable power working machine of the present invention.
Figure 6:
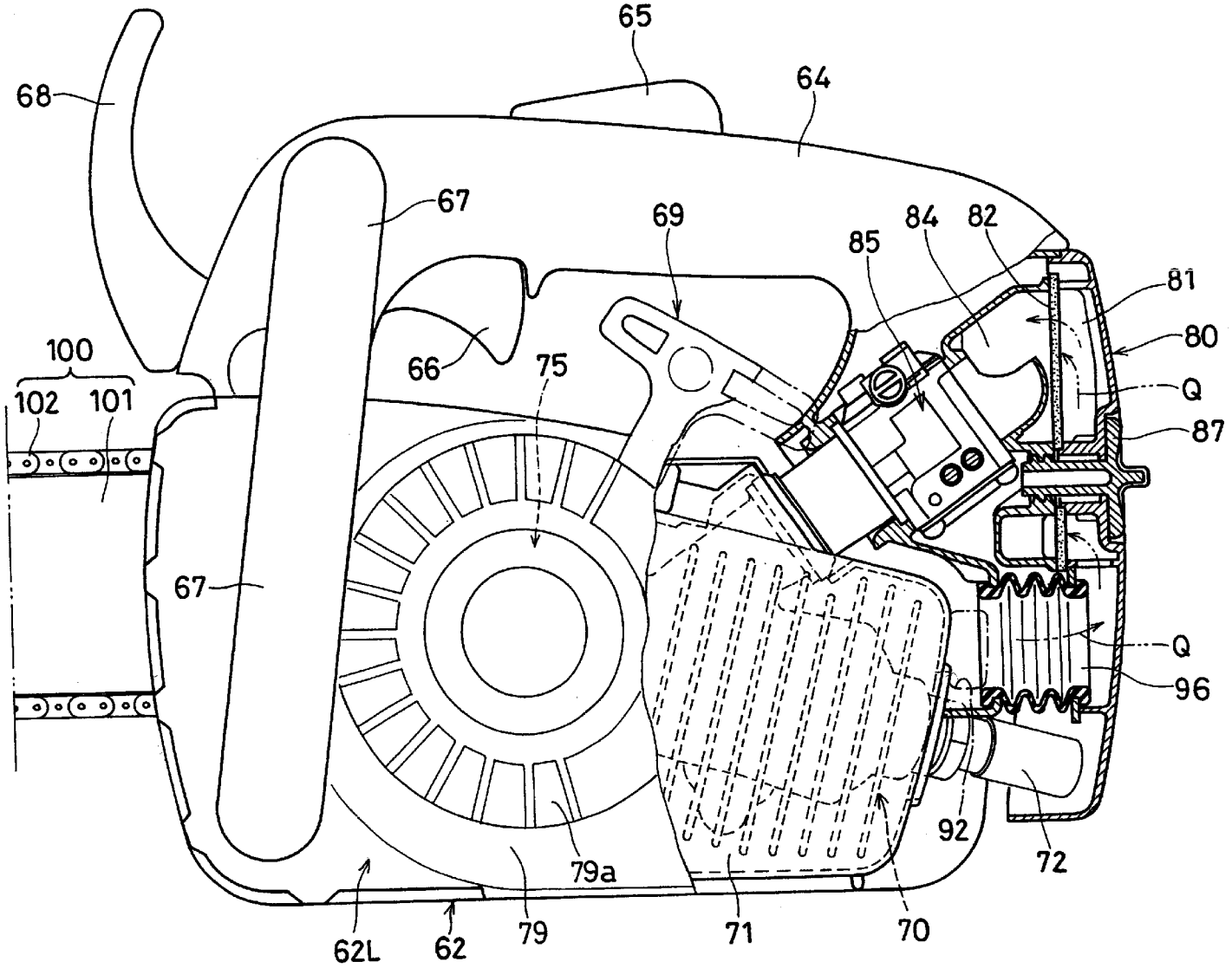
FIG. 6 is a left side view of the chain saw shown in FIG. 5, wherein the elements existing at a central portion (in the lateral direction) of the chain saw are sectioned.
Figure 7:
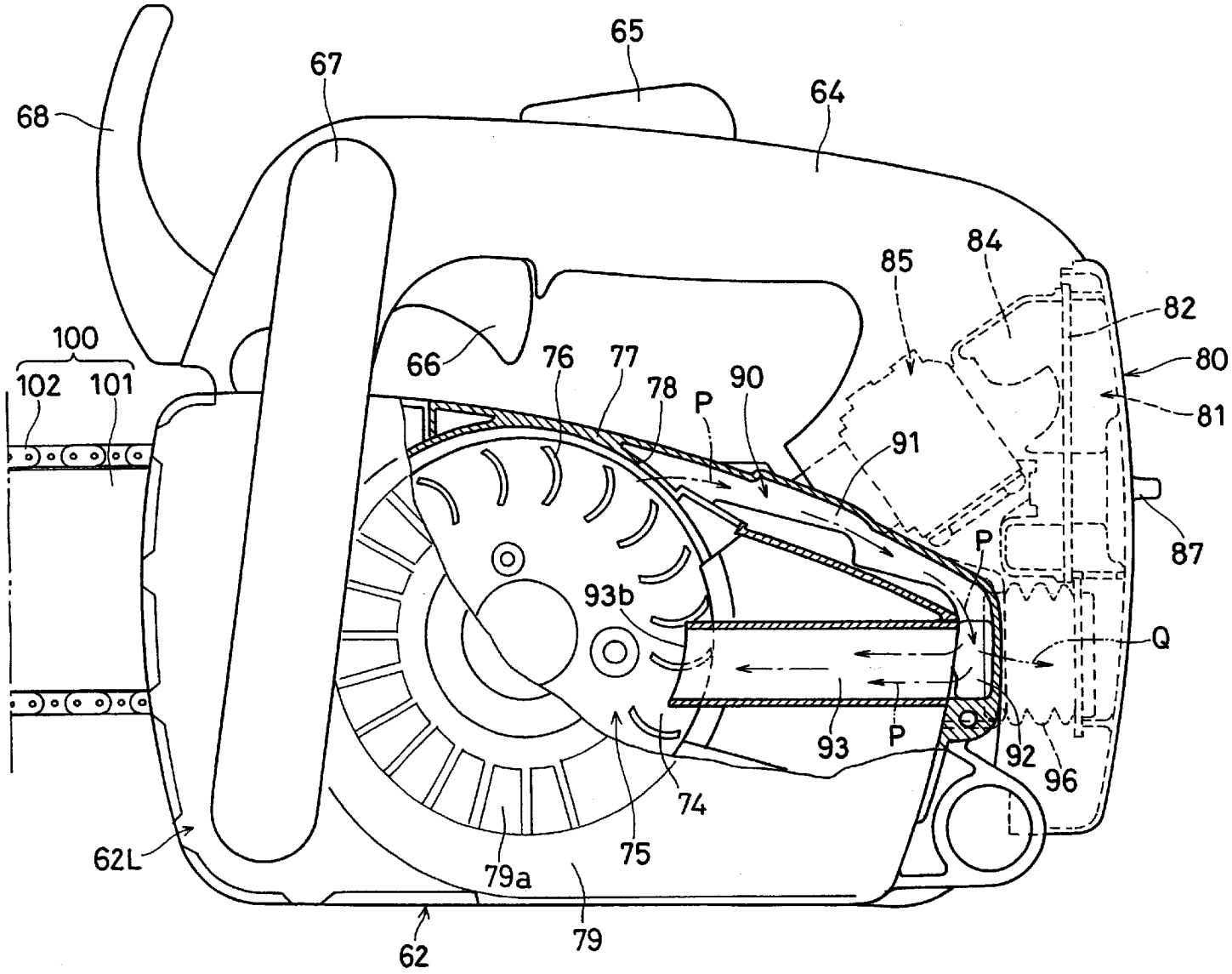
FIG. 7 is a left side view of the chain saw shown in FIG. 5, wherein the elements existing on the left side (in the lateral direction) of the chain saw are sectioned.

FIGS. 5 to 7 show another embodiment of a chain saw representing one of the portable power working machines according to the present invention. Referring to these FIGS., the illustrated embodiment is a chain saw 60, which is so called a top handle type chain saw and is featured in that, as a power driving source for actuating working components, a small air-cooled two-stroke gasoline engine (hereinafter referred to as an internal combustion engine) 70 is horizontally supported in a main housing 62 made of a synthetic resin with the cylinder head being slightly inclined downward (horizontal type). The internal combustion engine 70 is provided, on the head thereof, with an ignition plug 72 which is inclined rearwardly.

A saw chain set 100 composed of a guide bar 101 and a saw chain 102 slidably trained along the guide bar 101 is mounted as a working component on the forward right side 62R (FIG. 5) of the main housing 62. The saw-chain 102 is designed to be driven by the internal combustion engine 70. Further, on the left side 62L (FIG. 2) of the main housing 62, there are disposed a cooling fan 75 that is driven by the internal combustion engine 70, and also a recoil starter case 79 provided with an air-intake slit 79*a* and covering the impeller 76 of the cooling fan 75 and a volute case 77. In FIGS. 5–7, the reference number 64 denotes a top handle, 65 a throttle lock lever, 66 a throttle trigger, 67 a front handle, 68 a hand guard, and 69 a recoil starter.

At an upper portion 71 on the rear side of the internal combustion engine 70, there are disposed a diaphragm type carburetor 85 and a carburetor chamber 84. An air cleaner 80 is arranged next to the carburetor chamber 84 with a plate-like filter element 82 being interposed therebetween acting as a partitioning wall. The air cleaner 80 is cap-shaped and detachably attached, by means of a screw member 87, to the rear portion of the main housing 62.

According to this embodiment, part of external air that has been accelerated and pressurized as it is introduced by means of the cooling fan 25 is transmitted from a discharge port 78 formed at a peripheral portion of the volute case 77 (see FIG. 7) into a circulating air duct 90 so as to be sucked again by the cooling fan 75, thus enabling the air to recirculate. At the same time, part of the air flowing through the circulating air duct 90 is separated from an intermediate portion of the air flow (an intermediate duct portion 92) and deflected approximately orthogonally, thereby allowing this-part of air to be introduced into the internal combustion engine 70 through the cleaner 80 and the carburetor 85.

In particular, the circulating air duct 90 is provided at the rear half portion of the right side 62R of the main housing 62, the circulating air duct 90 being constituted by an upstream side passageway 91 extending from the discharge port 78 toward the air cleaner 80, the intermediate passageway 92 disposed below the filter element 82 of the air cleaner 80 and communicated with the upstream side passageway 91, and a downstream side passageway 93 communicated with the intermediate passageway 92 and having an open distal end 93*b* which is positioned in the vicinity of the intake port 74 (see FIG. 5) of the cooling fan 75.

According to the portable power working machine 60 of this embodiment as constructed above, during the operation thereof, the dust-containing air (cooling air) that has been introduced through the left side 62L of the main housing 62 by the sucking effect of the cooling fan 75, hence accelerated and pressurized, is transmitted so as to cool the internal combustion engine 70 and then discharged outside through a discharge port (not shown) formed at a portion of the main housing 62. At the same time, part of the air introduced into the main housing 62 is allowed to enter from the discharge port 78 formed at a peripheral portion of the terminal end of the volute case 77, and introduced, after passing through the upstream side passageway 91, the intermediate passageway 92 and the downstream side passageway 93, as a flow P into the cooling fan 75 so as to be sucked by the cooling fan 75 for the recirculation thereof as shown by a dot and dash line P in FIG. 7. At the same time, part of the air flowing through the circulating air duct 90 is separated from the other part of the air at the intermediate passageway 92 and directed, Q through a flexible bellows 96 disposed to communicate the main housing 62 with the air cleaner 80, in a direction orthogonal to the flow in the intermediate passageway 92, thereby enabling this part of air to be introduced, through the air cleaner chamber 81 of the air cleaner 80, the plate-like filter element 82, the carburetor chamber 84 and the carburetor 85, into the internal combustion engine 70.

In this case, since most of the dust existing in the air being introduced from the discharge port 78 into the circulating air duct 90 is caused, due to the gravity and inertia thereof, to be sucked by the cooling fan 75 after passing through the circulating air duct 90, the air which is separated from an intermediate portion 92 disposed lower than the air cleaner 80 placed in the circulating air duct 90 and directed to flow in a direction orthogonal to the intermediate passageway 92 can be substantially prevented from being contaminated by the dust.

As a result, it is now possible to minimize the clogging of the air cleaner 80, thus making frequent cleaning operation of the air cleaner 80 unnecessary and improving the efficiency of work.

Further, although the quantity of air introduced into the internal combustion engine 70 may be sharply reduced at the moment when the throttle valve (not shown) of the carburetor 85 is turned from a relatively wide-opened state back to a minimum opening (opening at idling of the engine), since the cooling fan 75 rotates at a high speed for a while due to the inertia, the sucking action by the cooling fan 75 to the dust in the air cleaner chamber 81 can be maintained, thereby making it possible to minimize the clogging of the plate-like filter element 82 by the action of the cooling fan 75.

While the foregoing embodiments of the present invention have been described in detail for the purpose of illustration, it will be understood that the construction of the device can be varied without departing from the spirit and scope of the invention.

For example, although the present invention has been explained in the above with reference to a chain saw, the present invention is also applicable to other kinds of portable power working machine, such as a power cutter and a hedge trimmer.

As explained above, since the portable power working machine according to the present invention is constructed such that part of the air that has been introduced into the main housing by means of a cooling fan is enabled to be sucked again by the cooling fan so as to recirculate it, it is now possible to minimize the clogging of the air cleaner, thus making frequent cleaning of the air cleaner unnecessary and improving the efficiency of work.

What is claimed is:

1. A portable power working machine comprising a main housing, a small air-cooled internal combustion engine received in the main housing, a cooling fan coupled to the internal combustion engine so as to be driven thereby, arranged to deliver cooling air into the main case to cool the internal combustion engine, and disposed on one side of the main housing, a carburetor chamber housing therein an air cleaner and a carburetor, and a pathway including a circulating air duct arranged such that part of air introduced into the main housing by means of the cooling fan is caused to be sucked again by the cooling fan so as to be recirculated through the main housing.

2. The portable power working machine according to claim 1, wherein the pathway includes the carburetor chamber, the circulating air duct has an inlet opening at an upstream end thereof communicating with the carburetor chamber, and part of the air introduced into the carburetor chamber along the pathway is introduced via the air cleaner into the internal combustion engine.

3. The portable power working machine according to claim 2, wherein the inlet opening of the circulating air duct is positioned lower than the air cleaner housed in the carburetor chamber, and the circulating air duct has an outlet opening at a downstream end thereof positioned in the vicinity of an air-intake port of the cooling fan.

4. The portable power working machine according to claim 3, wherein the inlet opening has a larger sectional area than that of the outlet opening.

5. The portable power working machine according to claim 3, wherein a guiding member is placed in the vicinity of the outlet opening of the circulating air duct, thereby effectively enhancing the air intake power of the cooling fan.

6. The portable power working machine according to claim 1, wherein the pathway is arranged such that part of the external air pressurized and accelerated due to the sucking power of the cooling fan passes through a discharge port formed at the outer periphery of a volute case of the cooling fan to an air-intake port of the cooling fan through the circulating air duct, thereby enabling part of external air to be recirculated, and wherein a conduit is provided to cause part of the air flowing through the circulating air duct to be withdrawn from an intermediate portion of the circulating air duct and to flow in a direction which is approximately orthogonal to the direction of the intermediate portion of the circulating air duct into the carburetor chamber, thereby enabling the air to be introduced into the internal combustion engine through the air cleaner and the carburetor.

7. The portable power working machine according to claim 6, wherein said circulating air duct is constituted by an upstream side passageway extending from the discharge port toward the air cleaner, the intermediate passageway disposed below the filter element of the air cleaner and communicated with the upstream side passageway, and a downstream side passageway communicated with the intermediate passageway and having an open distal end which is positioned in the vicinity of the air-intake port of the cooling fan.

8. The portable power working machine according to claim 6, wherein the air cleaner has a flat shaped filter element arranged as a partitioning wall in the carburetor chamber.

* * * * *